US009366265B2

(12) United States Patent
Tomita et al.

(10) Patent No.: US 9,366,265 B2
(45) Date of Patent: Jun. 14, 2016

(54) SCROLL SHAPE OF CENTRIFUGAL COMPRESSOR

(75) Inventors: Isao Tomita, Tokyo (JP); Takashi Shiraishi, Tokyo (JP); Kenichiro Iwakiri, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 530 days.

(21) Appl. No.: 13/978,897

(22) PCT Filed: Jan. 27, 2012

(86) PCT No.: PCT/JP2012/051892

§ 371 (c)(1),
(2), (4) Date: Jul. 24, 2013

(87) PCT Pub. No.: WO2012/132528

PCT Pub. Date: Oct. 4, 2012

(65) Prior Publication Data

US 2013/0294903 A1 Nov. 7, 2013

(30) Foreign Application Priority Data

Mar. 25, 2011 (JP) ..... 2011-068490

(51) Int. Cl.

| | |
|---|---|
| ***F04D 29/42*** | (2006.01) |
| ***F04D 29/40*** | (2006.01) |
| ***F04D 29/44*** | (2006.01) |
| ***F04D 29/68*** | (2006.01) |

(52) U.S. Cl.

CPC ..... *F04D 29/4206* (2013.01); *F04D 29/403* (2013.01); *F04D 29/4226* (2013.01); *F04D 29/441* (2013.01); *F04D 29/681* (2013.01); *F05D 2250/52* (2013.01)

(58) Field of Classification Search

CPC ..... F04D 29/403; F04D 29/4206; F04D 29/4226; F04D 29/44; F04D 29/681

See application file for complete search history.

(56) References Cited

U.S. PATENT DOCUMENTS

| | | | | |
|---|---|---|---|---|
| 3,848,040 | A * | 11/1974 | Dennis | B28B 1/261 249/125 |
| 5,624,229 | A | 4/1997 | Kotzur et al. | |
| 6,050,772 | A * | 4/2000 | Hatakeyama | F04D 29/283 29/888.024 |
| 7,500,825 | B2 * | 3/2009 | Hanai | F04D 29/4233 415/204 |

(Continued)

FOREIGN PATENT DOCUMENTS

| | | |
|---|---|---|
| CN | 1059959 A | 4/1992 |
| CN | 1763381 A | 4/2006 |
| CN | 101033756 A | 9/2007 |

(Continued)

OTHER PUBLICATIONS

Decision to grant a Patent for corresponding Japanese application No. 2011-068490 dated Nov. 11, 2013.

(Continued)

*Primary Examiner* — Ninh H Nguyen

(74) *Attorney, Agent, or Firm* — Birch, Stewart, Kolasch & Birch, LLP

(57) ABSTRACT

In a scroll shape of a centrifugal compressor, an enlargement rate of a ratio A/R of a cross-sectional area A of a scroll portion 12 to a radius R from an axis L1 of a compressor impeller 3 to a centroid $P_0$ of a cross section of the scroll portion is reduced from a winding start to a winding end of the scroll portion.

11 Claims, 7 Drawing Sheets

(56) References Cited

U.S. PATENT DOCUMENTS

| | | | |
|---|---|---|---|
| 2006/0086734 | A1 | 4/2006 | Song et al. |
| 2007/0212218 | A1 | 9/2007 | Seki et al. |

FOREIGN PATENT DOCUMENTS

| | | | |
|---|---|---|---|
| JP | 60-135696 | A | 7/1985 |
| JP | 3-217699 | A | 9/1991 |
| JP | 8-503284 | A | 4/1996 |
| JP | 8-177795 | A | 7/1996 |
| JP | 2001-263019 | A | 9/2001 |
| JP | 2005-2951 | A | 1/2005 |
| JP | 2009-221919 | A | 10/2009 |
| JP | 2010-138752 | A | 6/2010 |
| JP | 2010-209824 | A | 9/2010 |
| JP | 2010-216378 | A | 9/2010 |
| JP | 2012-137069 | A | 7/2012 |

OTHER PUBLICATIONS

European Search Report effective Nov. 17, 2014 issued in corresponding EP Application No. 12763192.7.

Chinese Office Action and Search Report, dated Jun. 3, 2015, for Chinese Application No. 201280013796.3, together with an English translation.

English machine translation of JP-2010-209824-A dated Sep. 24, 2010.

International Preliminary Report on Patentability and Written Opinion of the International Searching Authority, dated Oct. 10, 2013, for International Application No. PCT/JP2012/051892 (Forms PCT/IB/338, PCT/IB/326, PCT/IB/373 and PCT/ISA/237) and English translation.

* cited by examiner

SCROLL SHAPE OF CENTRIFUGAL COMPRESSOR

TECHNICAL FIELD

The present invention relates to a centrifugal compressor comprising a scroll portion which constitutes a flow path formed by rotation of a compressor impeller in a spiral shape in an outer peripheral portion of the compressor impeller, and to a scroll shape which enables recovery of static pressure of a fluid (gas) in the scroll portion.

BACKGROUND ART

Centrifugal compressors are required to have high pressure and high efficiency over a wide operating range.

FIG. 7 shows an enlarged sectional view of a substantial part of an upper half of an axis of a rotary shaft of a compressor impeller in a centrifugal compressor.

A compressor 1 of a centrifugal compressor mainly comprises a compressor impeller 3 constituted by a rotating hub 31 and a large number of centrifugal vanes 32 attached to an outer circumferential surface of the hub 31, a shaft 2 coupled to a rotary drive source of the compressor impeller 3, and a compressor housing 11 which houses the compressor impeller 3 and the shaft 2 and which forms a flow path of a fluid.

The compressor housing 11 is provided with a diffuser portion 13 which forms a roughly donut shape on an outer circumferential side of the compressor impeller 3 and which enables recovery of static pressure by decreasing the velocity of fluid that is discharged from the compressor impeller 3, a scroll portion 12 which is formed on an outer circumferential side of the diffuser portion 13 so that a cross-sectional area of the scroll portion 12 spirally increases in a circumferential direction and which collects gas over the entire circumference, and an outlet tube (not shown).

When the compressor impeller 3 rotates, the centrifugal vanes 32 compress a fluid such as a gas or air introduced from an air passageway 15. A flow (fluid) of gas or air or the like formed in this manner proceeds from an outer circumferential end of the compressor impeller 3, passes through the diffuser portion 13 and the scroll portion 12, and is sent out from the outlet tube.

FIG. 8 is a schematic diagram showing an example of the scroll portion 12 in plan view.

The scroll portion 12 has a constant distribution of a radius R (a centroid $P_0$ of a cross section of the cross section 12 and an axis L1 of the shaft 2) for positions determined at intervals of 30 degrees in a clockwise direction from a position of 60 degrees, where an end point (360 degrees in FIG. 8) of the scroll is set as a 0 base.

FIG. 9A shows a constant distribution of a radius R, wherein angle positions in a circumferential direction are plotted on a horizontal axis and the radius R from an axis L1 of a rotary shaft of the compressor of the scroll portion 12 to a centroid P of a scroll cross section is plotted on a vertical axis.

In addition, FIG. 9B is a cross-sectional view in which cross sections at respective circumferential positions (at intervals of 30 degrees) of the scroll portion 12 when a position at 60 degrees in a clockwise direction in FIG. 8 is set as a base are laminated on top of each other, and shows a variation of a centroid $P_0$ of the scroll cross section in a direction of the radius R.

Since fluid (gas) from the compressor impeller 3 flows into the scroll portion 12 via the diffuser portion 13 over approximately the entire circumference of the scroll portion 12, each cross-sectional area of the scroll portion 12 increases at a constant rate $\chi$ in a flowing direction of the fluid in accordance with an amount of inflow of the fluid.

Fluid velocity in the scroll becomes constant when equilibrium is established between the enlargement rate $\chi$ (constant rate) of the cross-sectional area of the scroll portion 12 and a rate of increase of the amount of fluid inflow into the scroll portion 12 from the diffuser portion 13.

Japanese Patent Application Laid-open No. 2010-209824 (Patent Document 1) discloses conventional art in which a shape of a scroll is varied.

In Patent Document 1, a first transition portion is provided in which a cross-sectional area of a scroll portion comprising a flow path formed in a spiral shape around a rotary shaft of rotor blades of a turbine which produces power by supplying a fluid gas to the rotor blades gradually decreases while a cross-sectional shape of the scroll portion transitions from a square shape with rounded corners to a circular shape, wherein curvature radii of the corner portions of the first transition portion are essentially set to a same magnitude.

In addition, by forming the first transition portion, giving the cross-sectional shape a square shape with rounded corners at phases where the scroll cross section can be increased, and giving the cross-sectional shape a circular shape at phases where the scroll cross section cannot be increased, the technique disclosed enables a sufficient cross-sectional area of the flow path to be secured in each phase and pressure loss of the fluid to be reduced.

Patent Document 1: Japanese Patent Application Laid-open No. 2010-209824

However, the technique according to Patent Document 1 is related to a scroll shape of a turbine which produces power by supplying a fluid gas to rotor blades and expanding the fluid gas, and differs from the present application in which a fluid (gas) is compressed with respect to how a fluid flows and in fluid characteristics.

Therefore, the way scroll shapes are viewed also differs.

In addition, centrifugal compressors are required to have a high pressure ratio and high efficiency over a wide range.

When a fluid flowing out from a compressor has velocity, since dynamic pressure increases but static pressure does not increase, pressure ratio and efficiency decline. Therefore, the velocity must be reduced within the compressor. Although pressure is recovered by reducing the velocity of the fluid in the diffuser portion, the velocity of the fluid differs between an inner side and an outer side of the scroll in a cross section of each portion of the scroll portion, which makes it difficult to accurately determine flow rate and velocity.

In addition, the velocity of the fluid in the scroll portion can conceivably be decreased by linearly increasing (increasing at a constant ratio) a size of cross sections of the scroll portion. In this case, due to constant decrease of velocity in a flow direction, a boundary layer between the fluid and a wall surface of the scroll portion increases and prevents sufficient static pressure recovery, and an occurrence of surging results in defects such as a reduction in an operating range and a decline in turbocharging efficiency.

DISCLOSURE OF THE INVENTION

The present invention has been made in order to solve such problems, and an object of the present invention is to enable a centrifugal compressor to produce high efficiency and high pressure by gradually increasing an enlargement rate in which a cross-sectional area of a scroll portion is enlarged from a tongue portion to an arbitrary angle in a circumferential direction of the scroll portion from an enlargement rate in accordance with an increase in an inflow amount of a fluid flowing through the scroll portion and subsequently reducing the enlargement rate of the cross-sectional area from the arbitrary angle to a winding end of the scroll portion in order to create a portion in which the velocity of the flow of the fluid in the scroll is decreased and a portion in which the velocity of the flow of the fluid in the scroll is increased to ensure sufficient static pressure recovery.

In order to solve the problems described above, the present invention provides a scroll shape of a centrifugal compressor which forms a flow path of a fluid such as a gas or air discharged from a diffuser portion arranged on a downstream-side of a compressor impeller of the centrifugal compressor, wherein an enlargement rate of a ratio A/R of a cross-sectional area A of a scroll portion to a radius R from an axis of the compressor impeller to a centroid of a cross section of the scroll portion due to an increase in a scroll angle is reduced from a winding start to a winding end of the scroll portion.

In addition, in the present invention, favorably, the ratio A/R is calculated as a sum of ratios Ai/ri of cross-sectional areas Ai and a constant radius ri when the cross section of the scroll portion is divided into band-like regions with the constant radius ri and the cross-sectional area Ai.

According to such a configuration, even when a scroll cross section often does not assume a symmetrical shape in a radial direction with respect to a centroid and fluid velocity differs between an outer circumferential side and an inner circumferential side, a highly accurate volumetric flow rate of a fluid is calculated to reduce fluid velocity and recover pressure, and by increasing the fluid velocity near a winding end of the scroll, development of a boundary layer between a wall surface of the scroll portion and the fluid is prevented to reduce loss (decrease flow rate resistance and improve pressure ratio) and stabilize flow.

Furthermore, favorably, the present invention further comprises a velocity decrease region which gradually increases the cross-sectional area of the scroll portion from a tongue portion of the scroll portion to an arbitrary angle in a winding direction of the scroll portion in order to decrease a velocity of the fluid and a velocity increase region which decreases a rate of enlargement of the cross-sectional area from the arbitrary angle to a winding end of the scroll portion to below the rate for the velocity decrease region in order to increase the velocity of the fluid.

According to such a configuration, by keeping an enlargement rate of a cross-sectional area of the scroll portion from the winding start of the scroll to an arbitrary angle higher than an enlargement rate in accordance with an increase in an inflow amount of a fluid flowing through the scroll portion, fluid velocity is reduced and pressure is recovered, and by setting the enlargement rate of the cross-sectional area from the arbitrary angle to the winding end of the scroll lower than the enlargement rate in accordance with the increase in the inflow amount of the fluid flowing through the scroll portion, fluid velocity is increased, development of a boundary layer between a wall surface of the scroll portion and the fluid is prevented to reduce loss (decrease flow rate resistance and improve pressure ratio) and stabilize flow.

In addition, in the present invention, favorably, when a distribution of A/R of the scroll cross section is displayed on coordinate axes including a horizontal axis which increases in a rightward direction from the winding start to the winding end of the scroll portion and a vertical axis on which the ratio A/R of the cross-sectional area A to the scroll radius R increases in an upward direction, the distribution of A/R has an upward convex shape.

By having the ratio A/R of the cross-sectional area A to the scroll radius R assume a fluid velocity characteristic curve with an upward convex shape on coordinate axes including a horizontal axis which plots a winding direction of a scroll portion and a vertical axis which plots the ratio A/R, characteristics are acquired in which a range up to a summit of the convex shape is set as a pressure recovery range and a range where the enlargement rate decreases from the summit is set as a fluid velocity increase range. As a result, development of a boundary layer between a wall surface of the scroll portion and the fluid can prevented and an effect of reducing loss (decreasing flow rate resistance and improving pressure ratio) can be produced.

Furthermore, in the present invention, favorably, the arbitrary angle is within a range of 300 to 330 degrees in a flowing direction of the fluid in the scroll when the winding end of the scroll is set as a 0 (zero) base.

According to such a configuration, by reducing fluid velocity to maximize the pressure recovery region and securing a minimum necessary region for increasing the velocity of the fluid up to a scroll end point, efficiency and pressure ratio as a centrifugal compressor are improved.

In addition, in the present invention, favorably, the rate of enlargement of the cross-sectional area of the scroll portion in a vicinity of the tongue portion is set lower than in the velocity decrease region.

According to such a configuration, since separation of the fluid due to the tongue portion occurs in the vicinity of the tongue portion, by gradually reducing the cross-sectional area of the portion in comparison with the radio of the enlarged portion, loss of fluid flow rate that is attributable to separation is reduced, efficiency and pressure ratio as a centrifugal compressor are improved, and an operating range is expanded.

Furthermore, in the present invention, favorably, the region in which the cross-sectional area in the vicinity of the tongue portion is decreased to below the ratio of the velocity decrease region is within approximately 30 to 60 degrees in the scroll direction from the tongue portion.

According to such a configuration, by determining a region that is not affected by separation of the fluid due to the tongue portion and maximizing the pressure recovery region in which fluid velocity is reduced, performance of the centrifugal compressor is improved.

In addition, in the present invention, favorably, a radius of a centroid of the cross section and a radius of a center of the scroll portion are varied while keeping the enlargement ratio of the cross-sectional area of the scroll portion constant in order to decrease the velocity of the fluid flowing through the scroll portion.

Furthermore, in the present invention, favorably, the radius of the centroid of the cross section of the scroll portion and a radius of a center of the scroll portion are kept constant while the enlargement rate of the cross-sectional area is varied in order to decrease the velocity of the fluid flowing through the scroll portion.

By gradually increasing the cross-sectional area of the scroll portion from the tongue portion to an arbitrary angle in a circumferential direction of the scroll portion and decreasing an enlargement rate of the cross-sectional area from the arbitrary angle to a winding end of the scroll portion, a portion in which a velocity of a flow of the fluid in the scroll is decreased and a portion in which the velocity of the flow of the fluid in the scroll is increased are created to ensure sufficient static pressure recovery and to produce high efficiency and high pressure as a centrifugal compressor.

BEST MODE FOR CARRYING OUT THE INVENTION

Figure 1:
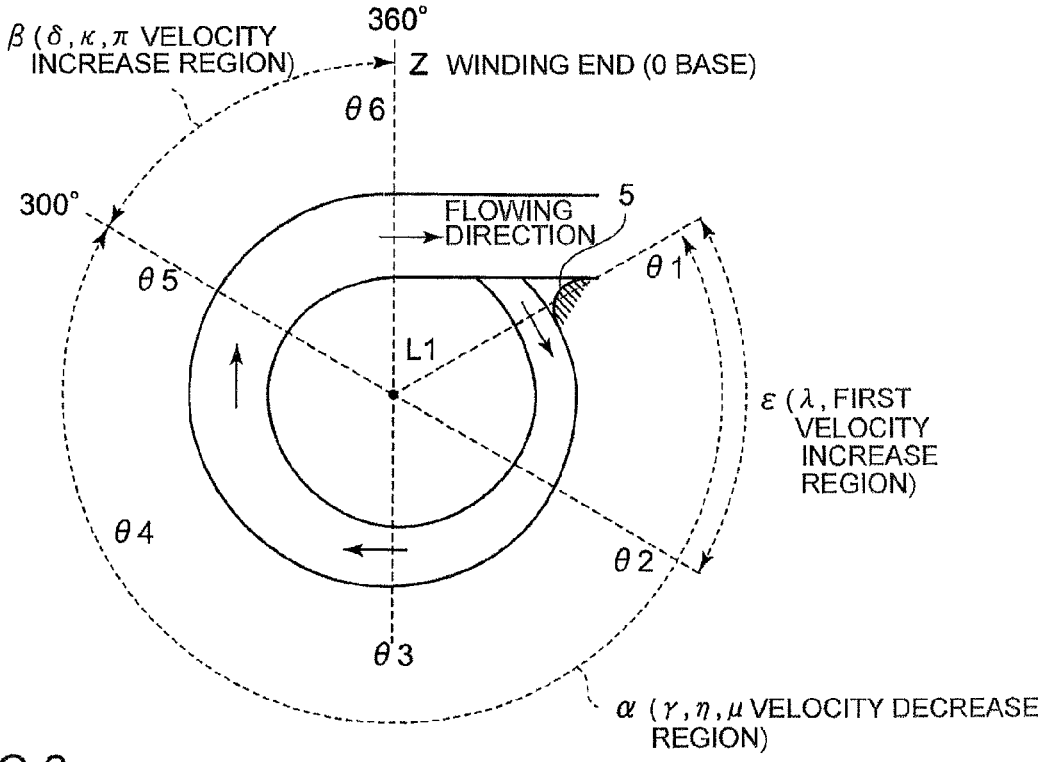
FIG. 1 is a diagram showing a shape of a scroll portion according to a first embodiment of the present invention.

Hereinafter, the present invention will be described in detail with reference to the embodiments illustrated in the drawings.

However, it is to be understood that, unless otherwise noted, dimensions, materials, shapes, relative arrangements, and the like of components described in the embodiments are not intended to limit the scope of the invention thereto and are merely illustrative examples.

First Embodiment

Figure 7:
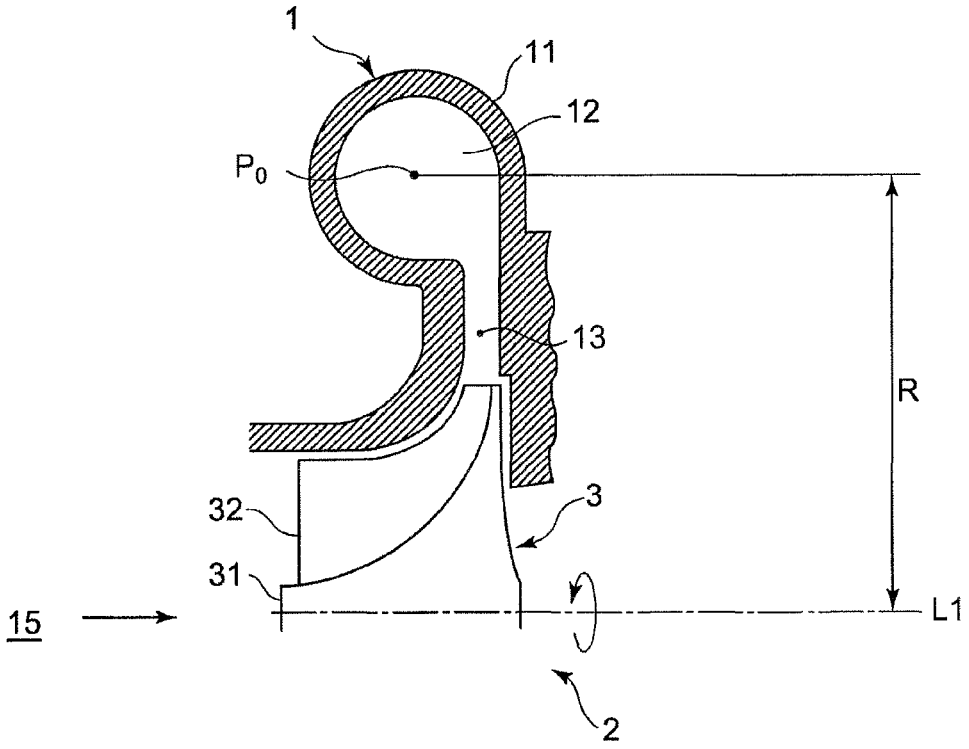
FIG. 7 shows an enlarged sectional view of a substantial part of an upper half of an axis of a rotary shaft of a compressor impeller in a centrifugal compressor according to the present invention.
Figure 8:
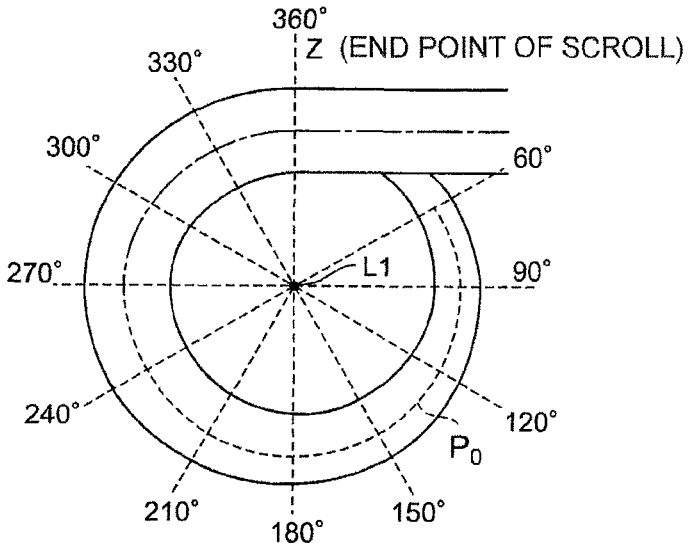
FIG. 8 is a diagram showing a scroll shape of a centrifugal compressor.
Figure 9B:
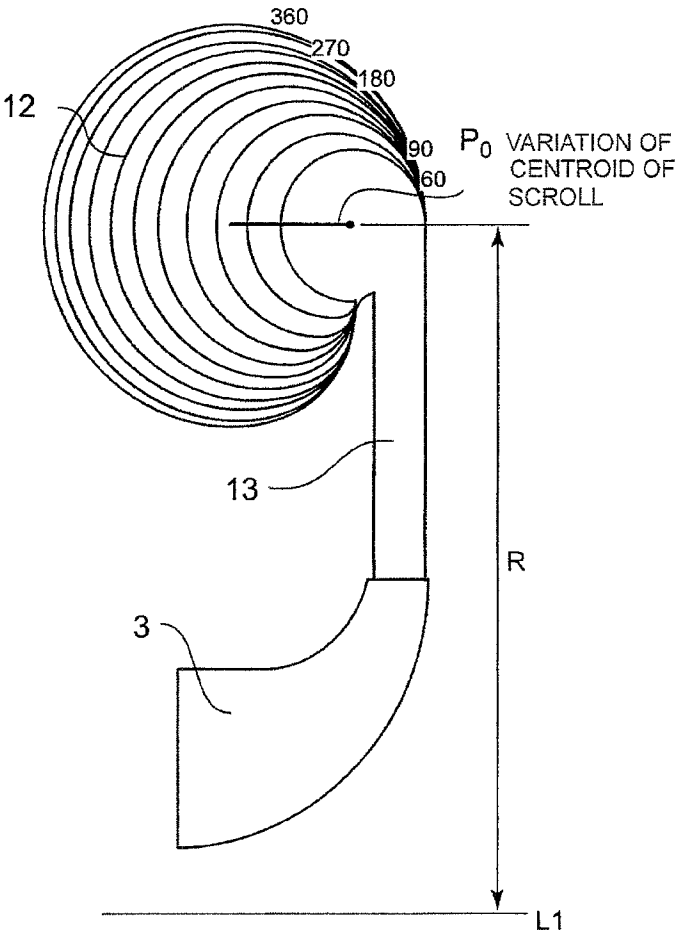
FIG. 9B is a sectional view showing cross sections at respective portions of a scroll laminated on top of each other.
Figure 9A:
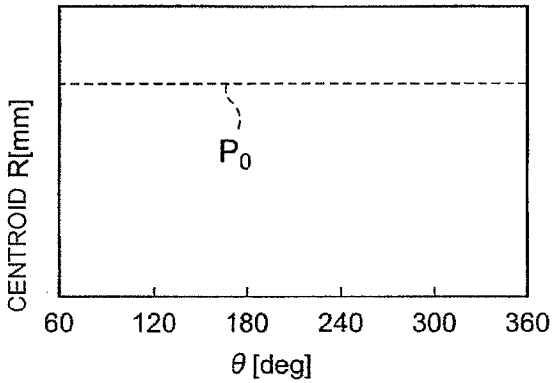
FIG. 9A is a diagram showing radii at respective portions in a circumferential direction of a scroll according to conventional art.

As shown in FIG. 7, a scroll according to the present invention comprises a fluid flow path constituted by a diffuser portion 13 which forms a roughly donut shape on an outer circumferential side of a compressor impeller 3 and which enables recovery of static pressure by decreasing the velocity of fluid (gas) that is discharged from the compressor impeller 3, a scroll portion 12 which is formed on an outer circumferential side of the diffuser portion 13 so that a cross-sectional area of the scroll portion 12 spirally increases in a winding direction (a flowing direction of the fluid) and which decreases velocity and increases pressure of the fluid, and an outlet tube (not shown).

When the compressor impeller 3 rotates, centrifugal vanes 32 compress a fluid such as a gas or air introduced from an air passageway 15. A flow of the fluid (gas) formed in this manner proceeds from an outer circumferential end of the compressor impeller 3, passes through the diffuser portion 13 and the scroll portion 12, and is sent out from the outlet tube.

A scroll shape of a centrifugal compressor according to the first embodiment of the present invention will be described with reference to FIGS. 1, 2, 3A, 3B, and 3C.

FIG. 1 shows the scroll portion 12 in plan view.

The scroll shape is roughly circular in a cross section in a radial direction of the scroll portion 12, and an area of the cross section gradually increases in a spiral shape from a position at 60 degrees in the winding direction to an end point Z (360 degrees) of the scroll portion, with the end point Z of the scroll portion is set as a 0 base (hereinafter, it is to be understood that a "cross section of the scroll portion" refers to a cross section in a direction perpendicular to an axis line of an air passageway in the scroll portion 12).

In addition, a tongue portion 5 which is a portion approximately consistent with a winding start position of the scroll portion 12 and which is an end edge of a partition between fluid discharged from the diffuser portion 13 and fluid having flowed through the scroll is arranged near a position at approximately 60 degrees in the winding direction shown in FIG. 1.

Figure 3A:
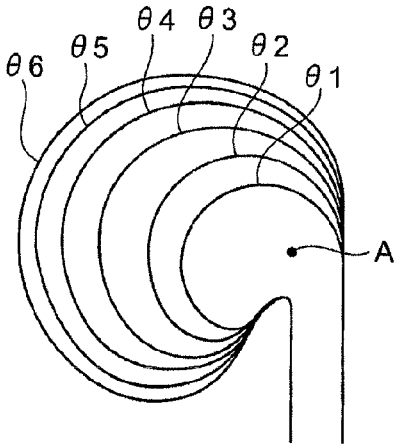
FIG. 3A is a sectional view showing cross sections at respective portions in a circumferential direction of a scroll laminated on top of each other according to the first embodiment of the present invention.
Figure 3B:
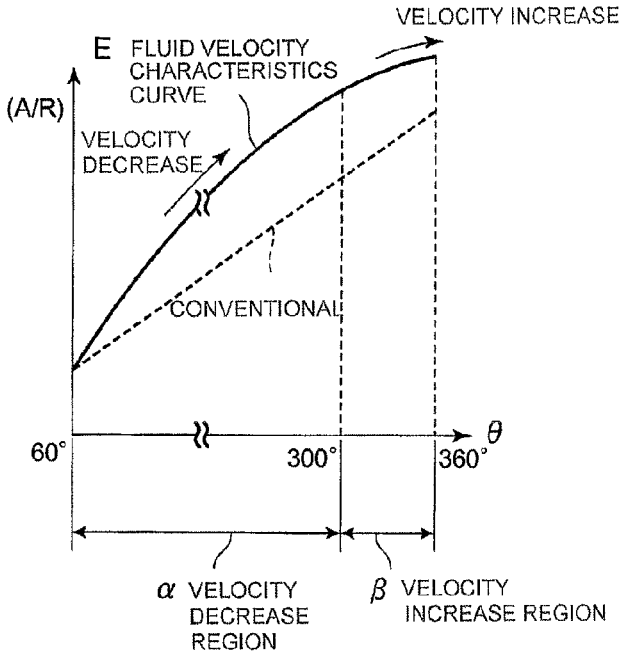
FIG. 3B is a diagram comparing A/R at respective portions in the scroll with a conventional case.
Figure 3C:
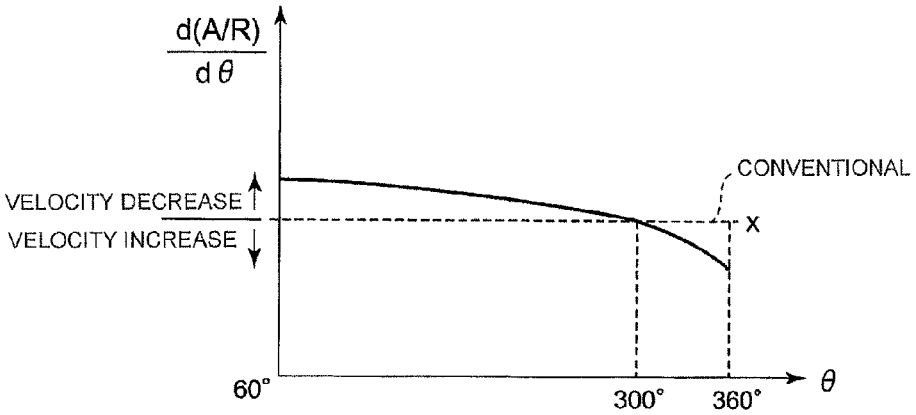
FIG. 3C is a diagram comparing a cross-sectional area enlargement rate (d(A/R)/dθ) at respective portions in the scroll with a conventional case.

Furthermore, as shown in FIGS. 3B and 3C, the scroll portion 12 has a velocity decrease region α in which a velocity of the fluid is decreased to recover static pressure and a velocity increase region β in which the velocity of the fluid is increased to stabilize flowage.

Normally, the following equation is frequently used when angular momentum of a fluid (gas) flowing through the scroll portion 12 is constant.

$$V\theta \times r = \text{constant} \tag{1}$$

Vθ: circumferential velocity r: radius (outer shape of impeller)

However, as is apparent from equation (1), a velocity of a fluid is greater on an inner side than on an outer side in a cross section of each portion of the scroll portion 12.

Therefore, a volumetric flow rate Q of the fluid flowing through the scroll portion 12 must take a size (shape) of the cross section and a radius of the scroll into consideration.

Figure 2:
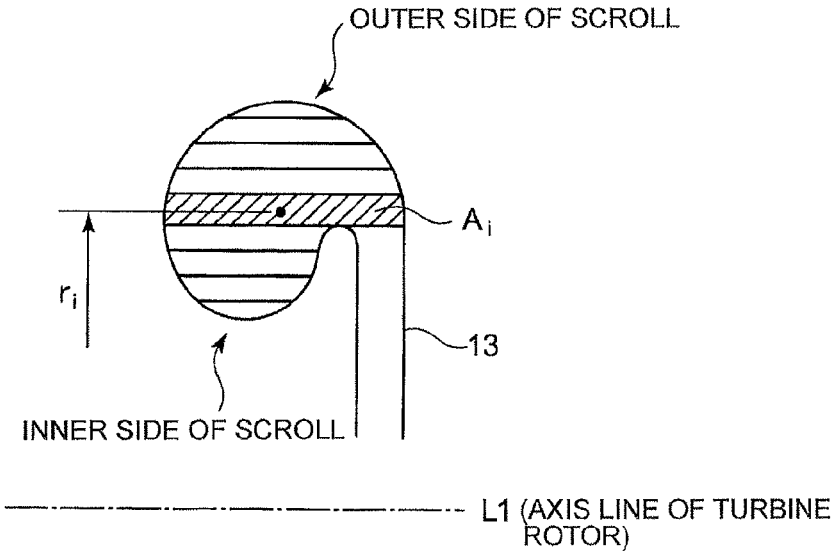
FIG. 2 is a diagram showing a cross-sectional shape of a scroll portion according to the first embodiment of the present invention.

Accordingly, the volumetric flow rate Q can be determined using the following equation by dividing a scroll cross section into band-like regions (cross-sectional area Ai) with a constant radius of ri as shown in FIG. 2 according to equation (1).

$$\text{volumetric flow rate } Q = \sum_{i=1}^{n} Qi = \sum_{i=1}^{n} V_{\theta_i A_i} \tag{2}$$

Meanwhile, $V\theta i \times ri = V\theta \times r$ is satisfied from equation (1).

$$V\theta i = V\theta \frac{r}{ri} \tag{3}$$

Substituting (3) into (2) results in $$Q = \sum_{i=1}^{n} V\theta \cdot \frac{r}{ri} \cdot Ai = V\theta r \sum_{i=1}^{n} \frac{Ai}{ri} \tag{4}$$

From equation (4), since $V\theta r$ represents a velocity in an outer circumferential portion of the diffuser 13 of a fluid discharged from the compressor impeller 3 and is constant over the entire outer circumferential portion of the diffuser 13, $V\theta r$ can be considered a constant (that is determined upon design).

Therefore, $$\sum_{i=1}^{n} \frac{Ai}{ri}$$

is a value which takes areas along respective cross-sectional shapes of the scroll into consideration.

Accordingly, by substituting as follows $$\sum_{i=1}^{n} \frac{Ai}{ri} = A/R$$

the volumetric flow rate Q of (4) can be expressed as $$Q = V\theta \cdot r \cdot A/R \tag{5}$$

Assuming that the flow rate Q which passes through each cross section of the scroll is constant, a flow velocity is determined based on the ratio A/R of the radius R, and flow velocity decreases as A/R increases.

In addition, by reducing A while keeping R constant, the velocity of a flowing fluid increases.

FIG. 3A is a sectional view displaying cross sections of the scroll portion at respective portions in a winding direction (the flowing direction of the fluid) laminated on top of each other according to the present embodiment. FIG. 3A represents a distribution when a cross-sectional area enlargement rate of A/R is varied and laminates cross sections of respective portions θ1, θ2, θ3, θ4, θ5, and θ6 in the circumferential direction of the scroll shown in FIG. 1.

Fluid (gas) from the compressor impeller 3 flows into the scroll portion 12 via the diffuser portion 13 over approximately the entire circumference of the scroll portion 12.

Therefore, in the present embodiment, A/R of each cross section of the scroll portion 12 is adjusted by increasing or decreasing a cross-sectional area enlargement rate (d(A/R)/dθ) associated with an increase in scroll angle and setting a constant enlargement rate based on a conventional scroll design in accordance with an inflow amount of fluid flowing through the scroll portion 12 as a base rate χ (threshold).

A magnitude of an interval between respective layers represents a magnitude of the area enlargement rate.

FIG. 3B is a diagram in which θ indicating an angle in the winding direction of the scroll is plotted on a horizontal axis and a ratio of A/R representing a size of a cross sectional area is plotted on a vertical axis, and which shows a fluid velocity characteristic curve E which is a velocity decreasing characteristic of fluid whose velocity decreases and increases as A/R varies.

In a similar manner, FIG. 3C represents A/R of the vertical axis in FIG. 3B as the cross-sectional area enlargement rate (d(A/R)/dθ) of a cross section.

Since A/R increases at a constant rate based on a conventional scroll design, conventional data is represented by an upward-sloping straight line in FIG. 3B and by a constant value parallel to the horizontal axis in FIG. 3C.

A region from θ1 (60 degrees) to 300 degrees is considered to be a velocity decrease region α which, in the case of FIG. 1, ranges from θ1 to θ5. A cross-sectional area enlargement rate ϕ of the velocity decrease region α is set higher than the base rate χ (threshold) that is a constant value depicted by a dashed line in FIG. 3C in order to reduce fluid velocity and recover static pressure.

A region from 300 degrees to a winding end of the scroll at 360 degrees is considered to be a velocity increase region β, and a cross-sectional area enlargement rate ω of the velocity decrease region β is set lower than the cross-sectional area enlargement rate χ in order to increase fluid velocity.

Therefore, the cross-sectional area enlargement rate (d(A/R)/dθ) has a magnitude of $\phi > \chi > \omega$.

In addition, by setting the cross-sectional area enlargement rate ϕ of A/R higher than the conventional base rate χ (dashed line) between 60 degrees and 300 degrees in the winding direction of the scroll, the velocity of the fluid in the scroll portion 12 decreases as the cross-sectional area increases (based on the description of equation (5)), and by setting the cross-sectional area enlargement rate ω of A/R lower than χ between 300 degrees and 360 degrees (the winding end of the scroll), the velocity of the fluid is increased. Accordingly, as shown in FIG. 3B, the fluid velocity characteristic curve E becomes a velocity decreasing characteristic with an upward convex shape, and a static pressure recovery portion and a velocity increase portion are formed in the scroll portion 12.

Moreover, the cross-sectional area enlargement rate (d(A/R)/dθ) shown in FIG. 3C shows a downward-sloping trend, in the direction toward the right side of the figure, from the winding start to the winding end of the scroll portion.

A region between scroll angles 60 degrees and 300 degrees in which the cross-sectional area enlargement rate has a greater value than the constant-value base rate χ shown as conventional in FIG. 3C is the velocity decrease region, and a region between 300 degrees and 360 degrees in which the cross-sectional area enlargement rate has a smaller value is the velocity increase region.

Moreover, the numerical values of θ1 (60 degrees) to 300 degrees which define the velocity decrease region α and 300 degrees to the winding end of the scroll at 360 degrees which define the velocity increase region β are not limited thereto.

In addition, a portion in which fluid velocity is increased at the winding end portion (360 degrees) of the scroll is set to 30 degrees in order to expand a region in which A/R increases and to maximize static pressure recovery of the fluid.

Therefore, an approximately similar effect can be obtained by setting a portion in which fluid velocity is increased to a region of around 30 degrees to 60 degrees (300 degrees to 360 degrees) preceding the winding end due to restrictions in shape or the like.

By setting the cross-sectional area enlargement rate ϕ of the scroll portion 12 from the winding start of the scroll to 300 degrees (arbitrary angle) higher than χ to decrease fluid velocity and recover pressure and by setting the cross-sectional area enlargement rate a near the winding end of the scroll lower than the cross-sectional area enlargement rate $\chi$ to increase fluid velocity, development of a boundary layer between a wall surface of the scroll portion 12 and the fluid is prevented. As a result, loss is reduced (flow rate resistance is reduced and pressure ratio is improved) and flow is stabilized.

Second Embodiment

The present embodiment will be described with reference to FIG. 4.

Moreover, in the present embodiment, since a basic shape is the same as that of the first embodiment with the sole exception of the shape of the scroll portion 12 which forms a flow path of a fluid such as gas or air discharged from the diffuser portion 13 that is arranged on a downstream side of the compressor impeller 3 of a centrifugal compressor, only the scroll portion 12 will be described and descriptions of other components will be omitted.

Moreover, the same terms will be denoted by the same reference characters and descriptions thereof will be omitted.

Figure 4A:
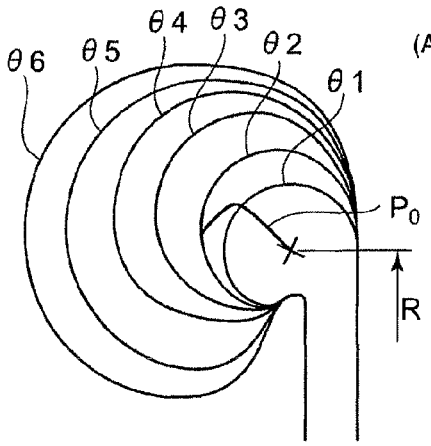
FIG. 4A is a sectional view showing cross sections at respective portions in a circumferential direction of a scroll laminated on top of each other according to a second embodiment of the present invention.

FIG. 4A is a sectional view displaying cross sections of the scroll portion at respective portions θ1, θ2, θ3, θ4, θ5, and θ6 in a winding direction of the scroll (the flowing direction of the fluid) shown in FIG. 1 laminated on top of each other according to the present embodiment. FIG. 4A represents a case where a centroid radius R of A/R is varied, in which θ1 (60 degrees) to 300 degrees forms a velocity decrease region γ of A/R and 300 degrees to the winding end of the scroll at 360 degrees forms a velocity increase region δ.

Figure 4B:
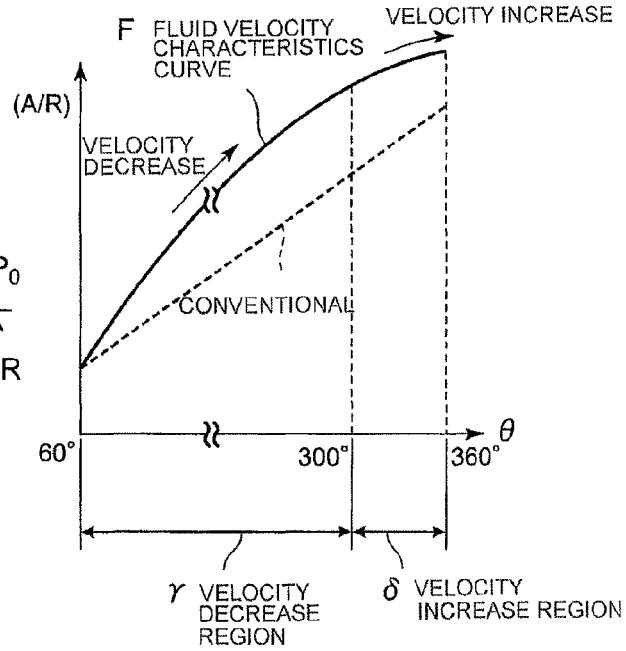
FIG. 4B is a diagram comparing A/R at respective portions in the scroll with a conventional case.

In FIG. 4A, $P_0$ represents a centroid of a cross section of each scroll portion 12 and a solid line with a mountain shape represents a variation in positions of the centroid $P_0$ in each cross section of the scroll portion. In addition, FIG. 4B is a diagram in which θ indicating an angle in the winding direction of the scroll is plotted on a horizontal axis and A/R is plotted on a vertical axis, and which shows a fluid velocity characteristic curve F in which the fluid velocity decreases as the degree of increase of A/R varies.

As described earlier, fluid (gas) from the compressor impeller 3 flows into the scroll portion 12 via the diffuser portion 13 over approximately the entire circumference of the scroll portion 12.

Therefore, in addition to decreasing the velocity of the fluid by setting the cross-sectional area enlargement rate higher than the base rate $\chi$ based on $Q=V\theta \cdot r \cdot A/R$ of equation (5) in a flowing direction of the fluid (winding direction) of A/R in each cross section of the scroll portion 12, the present embodiment includes an effect of decreasing the velocity of the fluid by enlarging the centroid R based on $V\theta \times r=\text{constant}$ of equation (1).

In the present embodiment, θ1 (60 degrees) to 300 degrees in which radius increases forms the velocity decrease region (γ) which approximately corresponds to a region in which the cross-sectional area enlargement rate is set higher than the base enlargement rate $\chi$. The fluid velocity characteristic curve F according to the present embodiment is a curve (an upward-convex curve in FIG. 4B) representing an increase and a decrease of the velocity of the fluid in the flowing direction of the fluid (winding direction) of the scroll portion 12.

This is an attempt to decrease the velocity of the fluid in the scroll portion 12 by increasing the radius R (based on equation (1)) and by setting the cross-sectional area enlargement rate higher than the base rate $\chi$ (a rate by which a cross-sectional area is enlarged according to an amount of fluid that flows into the scroll portion 12) (based on equation (5)).

Figure 4C:
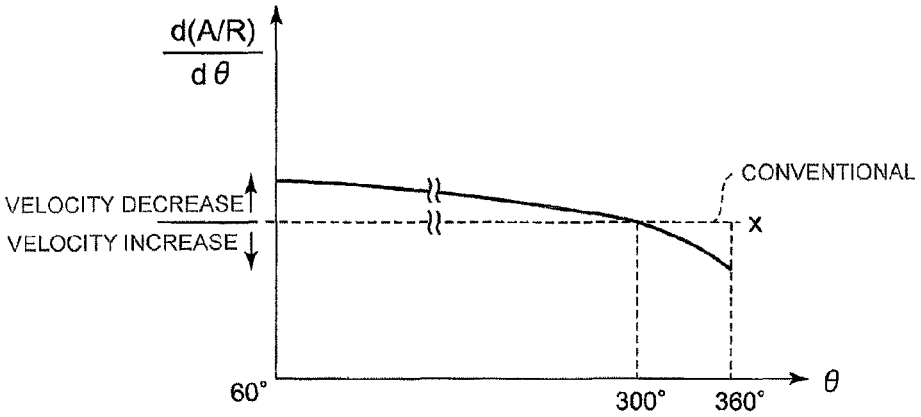
FIG. 4C is a diagram comparing a cross-sectional area enlargement rate (d(A/R)/dθ) at respective portions in the scroll with a conventional case.

The centroid radius is reduced in the flowing direction of the fluid between 300 degrees and 360 degrees (the winding end of the scroll) to form a curve representing an increase in velocity of the fluid (in FIG. 4B, the incline of the upward slope becomes less sharp and the cross-sectional area enlargement rate falls below the base enlargement rate $\chi$ in FIG. 4C). As a result, the entire fluid velocity characteristic curve F becomes a velocity decreasing characteristic with an upward convex shape, and a static pressure recovery portion and a velocity increase portion are formed in the scroll portion 12.

Moreover, the numerical values of θ1 (60 degrees) to 300 degrees which define the velocity decrease region γ (enlargement of A/R) and 300 degrees to the winding end of the scroll at 360 degrees which define the velocity increase region δ are not limited thereto.

In addition, a portion in which fluid velocity is increased at the winding end portion (360 degrees) of the scroll is set to 60 degrees (300 degrees to 360 degrees) in order to expand a region in which A/R is increased to maximize static pressure recovery of the fluid.

In the present embodiment, while the velocity increase region of fluid velocity is set to 60 degrees, experiment results show that an approximately similar effect can be obtained by setting the velocity increase region to a region around 30 degrees to 60 degrees (330 degrees to 360 degrees).

By setting the cross-sectional area enlargement rate higher than the base rate $\chi$ while gradually increasing the radius R in the velocity decrease region γ of the scroll portion 12 from the winding start of the scroll to 300 degrees (arbitrary angle) to decrease fluid velocity and recover pressure and by setting the cross-sectional area enlargement rate lower than the base rate $\chi$ while gradually reducing the centroid radius in the velocity increase region δ near the winding end of the scroll to increase fluid velocity, development of a boundary layer between a wall surface of the scroll portion 12 and the fluid is prevented. As a result, loss is reduced (flow rate resistance is reduced and pressure ratio is improved) and flow is stabilized.

Third Embodiment

The present embodiment will be described with reference to FIG. 5.

Moreover, in the present embodiment, since a basic shape is the same as that of the first embodiment with the sole exception of the shape of the scroll portion 12 of a centrifugal compressor which forms a flow path of a fluid such as gas or air discharged from a diffuser portion arranged on a downstream side of a compressor impeller of the centrifugal compressor, only the scroll portion 12 will be described and descriptions of other components will be omitted.

Moreover, the same terms will be denoted by the same reference characters and descriptions thereof will be omitted.

Figure 5A:
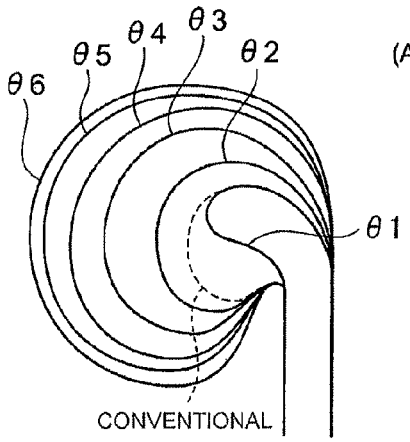
FIG. 5A is a sectional view showing cross sections at respective portions in a circumferential direction of a scroll laminated on top of each other according to a third embodiment of the present invention.

FIG. 5A is a sectional view displaying cross sections of the scroll portion at respective portions in a winding direction of the scroll (the flowing direction of the fluid) laminated on top of each other according to the present embodiment. FIG. 5A shows the lamination of cross sections of respective portions θ1, θ2, θ3, θ4, θ5, and θ6 in the circumferential direction of the scroll shown in FIG. 1.

In addition, a tongue portion 5 which is a portion approximately consistent with a winding start position of the scroll and which is an end edge of a partition between fluid discharged from the diffuser portion 13 and fluid having flowed through the scroll is arranged near a position at approximately 60 degrees in the flowing direction of the fluid shown in FIG. 1.

In FIG. 5A, θ1 which denotes a cross section of the scroll portion represents a cross-sectional area of the tongue portion 5, wherein a conventional cross-sectional shape is depicted by a dashed line and a cross-sectional shape according to the present application is depicted by a solid line. A separation occurs between the tongue portion 5 and the fluid near the tongue portion 5 due to the influence of the tongue portion 5.

Therefore, by reducing a cross-sectional area (A/R) near the tongue portion 5 by a flow area corresponding to a region in which separation occurs, loss attributable to separation is reduced (flow rate resistance is reduced and pressure ratio is improved) and flow is stabilized.

Figure 5B:
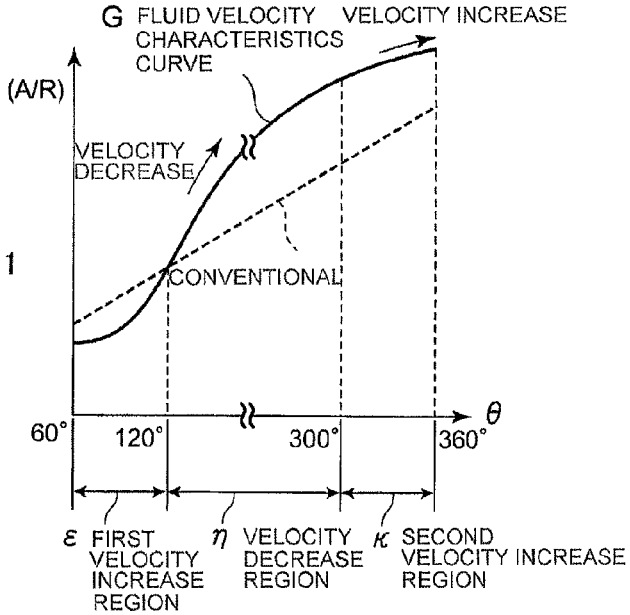
FIG. 5B is a diagram comparing A/R at respective portions in the scroll with a conventional case.

FIG. 5B is a diagram in which an angle θ in the winding direction of the scroll is plotted on a horizontal axis and an area A of A/R is plotted on a vertical axis, and which shows a fluid velocity characteristic curve G in which the fluid velocity decreases as the area A of A/R increases.

FIG. 50 is a diagram in which cross-sectional area enlargement rate (d(A/R)/dθ) is plotted on the vertical axis of FIG. 5B.

In addition, by setting A/R or the cross-sectional area enlargement rate (d(A/R)/dθ) lower than the base rate χ (threshold) (by reducing A/R or by reducing d(A/R)/dθ) between approximately 60 degrees to 120 degrees near the tongue portion 5, the fluid velocity of the portion is increased to resolve the separation between the tongue portion 5 and the fluid. As a result, a first velocity increase region ϵ is formed in which the fluid velocity characteristic curve G is positioned lower (fluid velocity is increased) than a conventional fluid velocity characteristic curve (dashed line).

A region from about 120 degrees in the winding direction of the scroll to the winding end is the same as that of the first embodiment, and by setting A/R or d(A/R)/dθ higher than a conventional base rate, a velocity decrease region η is formed and fluid velocity is reduced. In a region from 300 degrees in the vicinity of the winding end to 360 degrees that is the winding end, the cross-sectional area enlargement rate is set lower than that in the region from 120 degrees to 300 degrees to form a velocity increase region κ in which fluid velocity is increased.

Therefore, by reducing the cross-sectional area near the tongue portion 5, loss attributable to separation is reduced (flow rate resistance is reduced and pressure ratio is improved) and flow is stabilized.

In FIG. 5B, a region between scroll angles 60 degrees to 120 degrees is represented by a downward-convex graph and a region where the scroll angle is equal to or larger than 120 degrees is represented by an upward-convex graph in a similar manner to FIG. 3B.

Figure 5C:
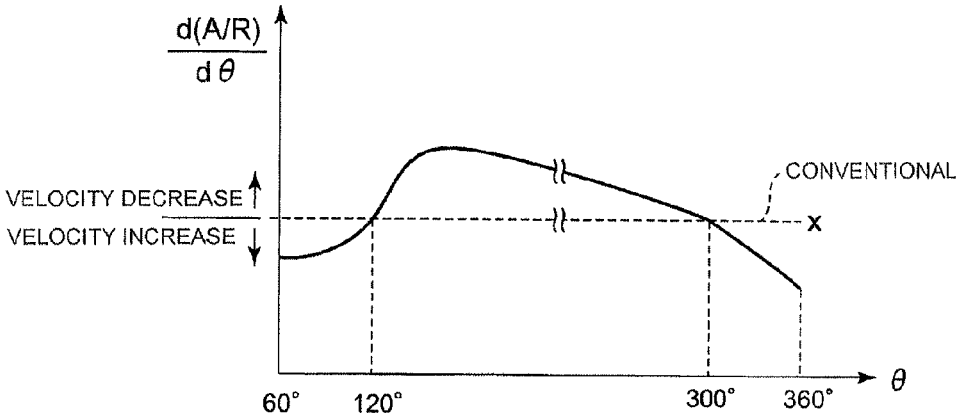
FIG. 5C is a diagram comparing a cross-sectional area enlargement rate (d(A/R)/dθ) at respective portions in the scroll with a conventional case.

In FIG. 5C, with respect to data (dashed line) indicating a conventional constant value, regions from 60 degrees to 120 degrees and from 300 degrees to 360 degrees represent velocity increase regions having values smaller than conventional values and a region from 120 degrees to 300 degrees forms an upward-convex graph in which values are greater than conventional values.

In addition, the numerical values of θ1 (60 degrees) to 120 degrees which define the first velocity increase region c of the tongue portion, 120 degrees to 300 degrees which define the velocity decrease region η, and 300 degrees to the winding end of the scroll at 360 degrees which define a second velocity increase region κ are not limited thereto.

Moreover, while the fluid velocity characteristic curve according to the present embodiment is positioned below the conventional fluid velocity characteristic curve (dashed line), even when the fluid velocity characteristic curve according to the present embodiment is positioned above, by setting A/R of the portion lower than the cross-sectional area enlargement rate ϕ, a similar effect can be produced as long as a downward-concave fluid velocity characteristic curve G is formed.

Fourth Embodiment

The present embodiment will be described with reference to FIG. 6.

Moreover, in the present embodiment, since a basic shape is the same as that of the second embodiment with the sole exception of the shape of the scroll portion 12 of a centrifugal compressor which forms a flow path of a fluid such as gas or air discharged from a diffuser portion arranged on a downstream side of a compressor impeller of the centrifugal compressor, only the scroll portion 12 will be described and descriptions of other components will be omitted.

Figure 6A:
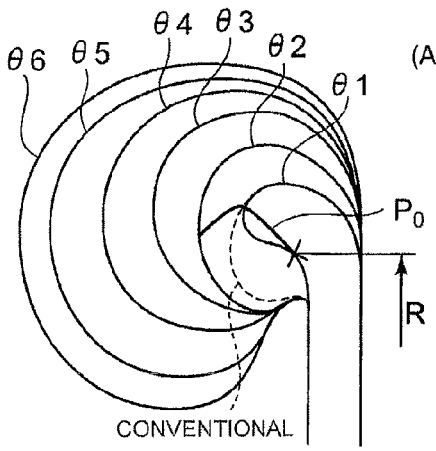
FIG. 6A is a sectional view showing cross sections at respective portions in a circumferential direction of a scroll laminated on top of each other according to a fourth embodiment of the present invention.

FIG. 6A is a sectional view according to the present embodiment which represents a case where a centroid radius R of A/R is varied and which shows cross sections of the scroll portion at respective portions θ1, θ2, θ3, θ4, θ5, and θ6 in a winding direction of the scroll (the flowing direction of the fluid) shown in FIG. 1 laminated on top of each other.

Figure 6B:
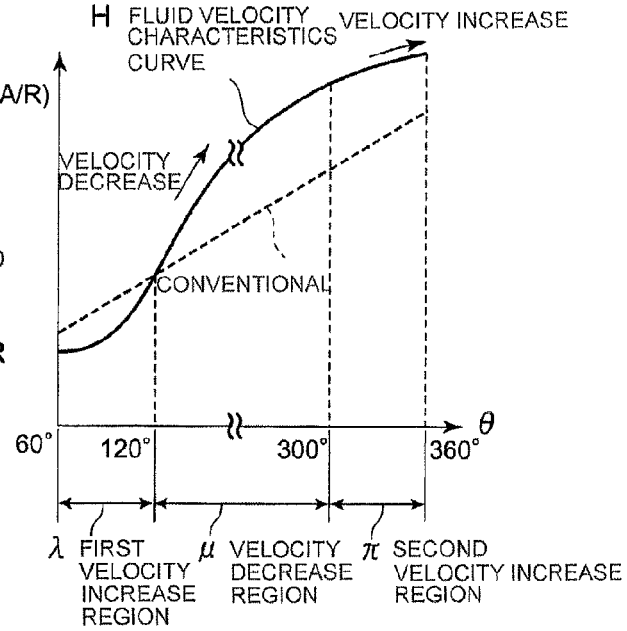
FIG. 6B is a diagram comparing A/R at respective portions in the scroll with a conventional case.

$P_0$ represents a centroid of each cross section of the scroll portion 12, and a solid line with a mountain shape represents a variation in positions of the centroid $P_0$ (a variation of R) in each scroll portion 12. FIG. 6B is a diagram in which θ indicating an angle in the winding direction of the scroll is plotted on a horizontal axis and a radius R of A/R is plotted on a vertical axis, and which shows a fluid velocity characteristic curve H in accordance with a variation in the radius R of A/R.

The radius R of a conventional centroid $P_0$ is constant (dashed line) at respective portions in the winding direction of the scroll.

In addition, in FIG. 6A, θ1 which denotes a cross section of the scroll portion represents a cross-sectional area of the tongue portion 5, wherein a conventional cross-sectional shape is depicted by a dashed line and a cross-sectional shape according to the present embodiment is depicted by a solid line.

In FIG. 6B, a region between scroll angles 60 degrees to 120 degrees is represented by a downward-convex graph and a region where the scroll angle is equal to or larger than 120 degrees is represented by an upward-convex graph in a similar manner to FIG. 3B.

Figure 6C:
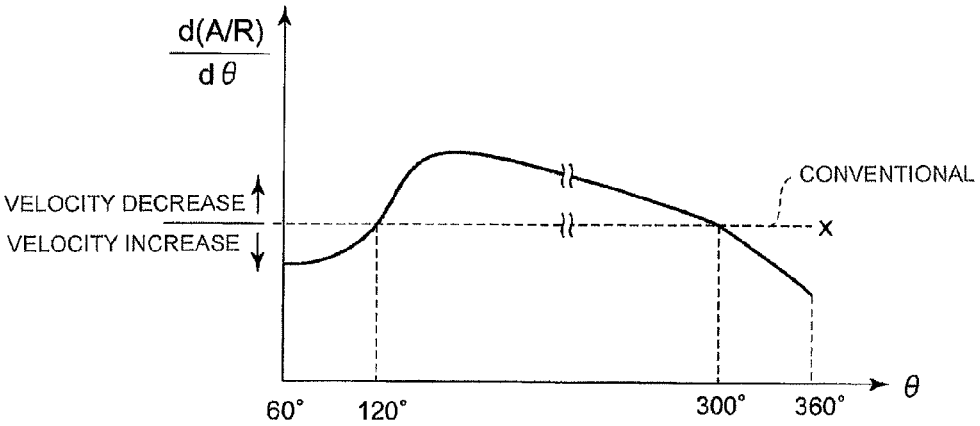
FIG. 6C is a diagram comparing a cross-sectional area enlargement rate (d(A/R)/dθ) at respective portions in the scroll with a conventional case.

In FIG. 6C, with respect to data (dashed line) indicating a conventional constant value, regions from 60 degrees to 120 degrees and from 300 degrees to 360 degrees represent velocity increase regions having values smaller than conventional values and a region from 120 degrees to 300 degrees forms an upward-convex graph in which values are greater than conventional values.

As described in the third embodiment, a separation occurs between the tongue portion 5 and the fluid near the tongue portion 5 due to the influence of the tongue portion 5.

FIG. 6B is a diagram in which an angle θ in the winding direction of the scroll (the flowing direction of the fluid) is plotted on a horizontal axis and A/R is plotted on a vertical axis, and which shows a fluid velocity characteristic curve H in which the fluid velocity decreases as the enlargement rate of A/R increases.

FIG. 6C is a diagram in which cross-sectional area enlargement rate (d(A/R)/dθ) is plotted on the vertical axis of FIG. 6B.

In addition, by setting the cross-sectional area enlargement rate lower than the base rate χ between approximately 60 degrees and 120 degrees near the tongue portion 5, the fluid velocity of the portion is increased to resolve the separation between the tongue portion 5 and the fluid.

Therefore, by reducing a cross-sectional area ratio A/R near the tongue portion 5 by an amount (cross-sectional area) corresponding to a region in which separation occurs, loss attributable to separation is reduced (flow rate resistance is reduced and pressure ratio is improved) and flow is stabilized. Means of reducing the cross-sectional area A between approximately 60 degrees to 120 degrees near the tongue portion 5 include a method of reducing a radially-inner portion of the cross section θ1 as shown in FIG. 5A.

A region between approximately 120 degrees in the winding direction of the scroll to the winding end is the same as that according to the second embodiment, wherein by setting the cross-sectional area enlargement rate higher than the base rate $\chi$ while increasing the centroid R in the flowing direction of the fluid, a velocity decrease region $\mu$ is formed and fluid velocity is reduced. By setting the cross-sectional area enlargement rate lower than the base rate $\chi$ while decreasing the centroid R in the flowing direction of the fluid in a region from 300 degrees in the vicinity of the winding end to 360 degrees that is the winding end, a second velocity increase region $\pi$ is formed in which the velocity of the fluid is increased.

INDUSTRIAL APPLICABILITY

The present invention relates to a centrifugal compressor comprising a scroll portion shape which constitutes a flow path formed in a spiral shape in an outer peripheral portion of a compressor impeller due to the rotation of the compressor impeller, and is favorably used in a centrifugal compressor which enables recovery of static pressure in the scroll portion to obtain high compressor performance.

The invention claimed is:

1. A scroll shape of a centrifugal compressor which forms a flow path of a fluid such as a gas or air discharged from a diffuser portion arranged on a downstream-side of the compressor impeller of the centrifugal compressor, wherein an enlargement rate of a ratio A/R of a cross-sectional area A of a scroll portion to a radius R from an axis of the compressor impeller to a centroid of a cross section of the scroll portion due to an increase in a scroll angle is reduced from a winding start to a winding end of the scroll portion.

2. The scroll shape of a centrifugal compressor according to claim 1, wherein the ratio A/R is calculated as a sum of ratios Ai/Ri of cross-sectional areas Ai and a constant radius Ri when the cross section of the scroll portion is divided into band-like regions with the constant radius Ri and the cross-sectional area Ai.

3. The scroll shape of a centrifugal compressor according to claim 2, wherein when a distribution of A/R of the scroll cross section is displayed on coordinate axes including a horizontal axis which increases in a rightward direction from the winding start to the winding end of the scroll portion and a vertical axis on which the ratio A/R of the cross-sectional area A to the scroll radius R increases in an upward direction, the distribution of A/R has an upward convex shape.

4. The scroll shape of a centrifugal compressor according to claim 1, further comprising a velocity decrease region which gradually increases the cross-sectional area of the scroll portion from a tongue portion of the scroll portion to an arbitrary angle in a winding direction of the scroll portion in order to decrease a velocity of the fluid and a velocity increase region which decreases a rate of enlargement of the cross-sectional area from the arbitrary angle to a winding end of the scroll portion to below the rate for the velocity decrease region in order to increase the velocity of the fluid.

5. The scroll shape of a centrifugal compressor according to claim 4, wherein when a distribution of A/R of the scroll cross section is displayed on coordinate axes including a horizontal axis which increases in a rightward direction from the winding start to the winding end of the scroll portion and a vertical axis on which the ratio A/R of the cross-sectional area A to the scroll radius R increases in an upward direction, the distribution of A/R has an upward convex shape.

6. The scroll shape of a centrifugal compressor according to claim 1, wherein when a distribution of A/R of the scroll cross section is displayed on coordinate axes including a horizontal axis which increases in a rightward direction from the winding start to the winding end of the scroll portion and a vertical axis on which the ratio A/R of the cross-sectional area A to the scroll radius R increases in an upward direction, the distribution of A/R has an upward convex shape.

7. The scroll shape of a centrifugal compressor according to claim 1, wherein the arbitrary angle is within a range of 300 to 330 degrees in a flowing direction of the fluid in the scroll when the winding end of the scroll is set as a 0 (zero) base.

8. The scroll shape of a centrifugal compressor according to claim 7, wherein the region in which the cross-sectional area in the vicinity of the tongue portion is decreased to below the ratio of the gradual enlargement portion is within approximately 30 to 60 degrees in the scroll direction from the tongue portion.

9. The scroll shape of a centrifugal compressor according to claim 1, wherein the rate of enlargement of the cross-sectional area of the scroll portion in a vicinity of the tongue portion increases in the flowing direction of the fluid.

10. The scroll shape of a centrifugal compressor according to claim 1, wherein a radius of a centroid of the cross section of the scroll portion is varied in order to decrease the velocity of the fluid flowing through the scroll portion.

11. The scroll shape of a centrifugal compressor according to claim 1, wherein the radius of the centroid of the cross section of the scroll portion and a radius of a center of the scroll portion are kept constant while the enlargement rate of the cross-sectional area is varied in order to decrease the velocity of the fluid flowing through the scroll portion.

* * * * *